US006736187B2

(12) United States Patent
Kamata

(10) Patent No.: US 6,736,187 B2
(45) Date of Patent: May 18, 2004

(54) MOLTEN METAL INFILTRATING METHOD AND MOLTEN METAL INFILTRATING APPARATUS

(75) Inventor: Takeshi Kamata, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/942,762

(22) Filed: Aug. 31, 2001

(65) Prior Publication Data

US 2002/0034587 A1 Mar. 21, 2002

(30) Foreign Application Priority Data

Aug. 31, 2000 (JP) ..... P.2000-262904

(51) Int. Cl.[7] ..... B22D 19/14; B22D 11/00
(52) U.S. Cl. ..... 164/102; 164/461; 164/419
(58) Field of Search ..... 164/102, 100, 164/101, 461, 419; 427/310

(56) References Cited

U.S. PATENT DOCUMENTS

| | | | | | |
|---|---|---|---|---|---|
| 2,072,060 | A | * | 2/1937 | Schultz | 164/63 |
| 3,720,257 | A | * | 3/1973 | Beutler et al. | 164/75 |
| 3,842,896 | A | * | 10/1974 | Dobo | 164/461 |
| 3,924,036 | A | * | 12/1975 | Carrara | 427/431 |
| 4,082,864 | A | | 4/1978 | Kendall et al. | |
| 4,169,426 | A | * | 10/1979 | Kornmann et al. | 118/67 |
| 4,321,289 | A | * | 3/1982 | Bartsch | 427/287 |
| 4,376,803 | A | | 3/1983 | Katzman | |
| 4,659,593 | A | * | 4/1987 | Rocher et al. | 427/310 |
| 5,410,796 | A | | 5/1995 | Weeks, Jr. | |
| 6,035,925 | A | * | 3/2000 | Blucher | 164/419 |
| 6,037,011 | A | * | 3/2000 | Deegan et al. | 427/433 |

FOREIGN PATENT DOCUMENTS

| | | | |
|---|---|---|---|
| DE | 43 03 434 C1 | | 8/1994 |
| EP | 1 143 028 A1 | | 10/2001 |
| JP | 58144441 A | * | 8/1983 |
| JP | 61017351 A | * | 1/1986 |
| JP | 2001-170754 | | 6/2001 |

* cited by examiner

*Primary Examiner*—Tom Dunn
*Assistant Examiner*—Kevin McHenry
(74) *Attorney, Agent, or Firm*—Sughrue Mion, PLLC

(57) ABSTRACT

A molten metal infiltrating method for infiltrating a linear material with a molten metal, wherein a linear material previously coated with a flux is used.

6 Claims, 5 Drawing Sheets

PRIOR ART

MOLTEN METAL INFILTRATING METHOD AND MOLTEN METAL INFILTRATING APPARATUS

BACKGROUND OF INVENTION

1. Field of the Invention

The present invention relates to a molten metal infiltrating method for manufacturing a metal based composite material such as a fiber reinforced metal.

2. Related Art

Since a metal material reinforced by a linear material such as a fiber reinforced metal is more excellent in a thermal resistance and a specific strength than an ordinary composite material, and furthermore, is excellent in electrical conduction, it has been particularly applied and developed mainly in the aerospace field, building structures or the telecommunication field.

Although such a metal reinforced by a linear material is obtained by heating to a melting temperature for the metal or more while pressurizing a linear material plated with the metal, it is usually manufactured by a method of immersing a linear material in a molten metal which has excellent productivity and is advantageous to a cost.

The method of infiltrating a linear material with a molten metal will be described below with reference to the drawings.

FIG. 4 is a model view showing an example of a pressure melting and infiltrating type linear composite material manufacturing apparatus 101.

An electric furnace 102 having a molten metal 103 in a pressure chamber 104 which can be pressurized is provided and a linear material bundle 105 (in this example, a fiber) is continuously introduced into the chamber through an inlet seal portion provided in the lower part of the chamber.

The linear material thus introduced is immersed in the molten metal in the electric furnace. At this time, the linear material bundle is infiltrated with the metal. Then, the linear material infiltrated with the metal is continuously taken out of an outlet seal portion provided in the top part of the chamber and is changed into a linear composite material 106 when the metal is solidified. The inside of the pressure chamber is pressurized by an inert gas against the molten metal. Therefore, it is possible to prevent an infiltration defect portion such as a void from being generated during the infiltration.

In the case in which such a pressure melting and infiltrating type linear composite material manufacturing apparatus is used, a comparatively excellent composite material can be obtained if the molten metal is aluminum or an aluminum alloy and the linear material is a silicon carbide (SiC) fiber or an alumina fiber. However, the silicon carbide fiber and the alumina fiber are very expensive. On the other hand, if a carbon fiber which is advantageous to a cost is used for the linear material, a gap is generated between the linear material and a matrix metal or a void (matrix infiltration defect portion) is generated because a wettability to the molten metal on the surface of the linear material is poor. Therefore, performance (electrical or mechanical performance) to be originally obtained cannot be acquired and an improvement thereof has been required.

In order to improve the wettability to the molten metal on the surface of the linear material, there has been proposed a method of previously providing a metal layer on the surface of a linear material.

As an example, a metal spraying method and a vacuum depositing method have been known.

FIG. 5 shows a model of an apparatus 107 to be used for the metal spraying and vacuum depositing method.

In FIG. 5, a pair of electrodes 108 are provided in a vacuum chamber 110 and a voltage is applied thereto. The vacuum chamber 110 is filled with a metal vapor and a metal layer is formed on the surface of a linear material 105 (in this example, a fiber) introduced continuously from the lower part of the chamber 110. Then, the linear material 109 having the metal layer formed on the surface is continuously taken out of an outlet seal portion. The chamber 110 is connected to a vacuum line and an internal pressure reducing state can be maintained.

For a pretreatment of the metal spraying and vacuum depositing method, however, troubles are easily made over the maintenance of a vacuum and effects thereof are not stable in many cases. Moreover, a cost is increased. For this reason, there has also been proposed a metal spraying and vacuum depositing apparatus having a linear material wound upon a bobbin and a winding bobbin provided in a vacuum chamber. In this case, there has been a drawback that the cost cannot be considerably reduced and productivity is much poorer.

SUMMARY OF INVENTION

The invention has an object to provide a molten metal infiltrating method capable of improving the conventional problems, that is, producing a linear material reinforced metal material having ideal performance with high productivity and stable productivity without considerably increasing the cost.

In order to solve the problems, a first aspect of the invention is directed to a molten metal infiltrating method for infiltrating a linear material with a molten metal, wherein a linear material previously coated with a flux is used.

Moreover, a second aspect of the invention is directed to the molten metal infiltrating method according to the first aspect of the invention, wherein a linear material to be a core is continuously introduced through an inlet seal portion provided in a bottom part of a bath container having a molten metal on a pressurized inside and is consecutively taken out of an outlet seal portion provided in a top part of the infiltrating reservoir, the linear material introduced into the bath container through the inlet seal portion being continuously coated with a flux by a flux coating reservoir provided in the vicinity of the inlet seal portion.

A third aspect of the invention is directed to a molten metal infiltrating apparatus comprising a bath container having an inlet seal portion in a bottom part and an outlet seal portion in a top part, and flux coating means for coating, with a flux, a linear material continuously introduced into the bath container through the inlet seal portion in the vicinity of the inlet seal portion.

DETAILED DESCRIPTION OF PREFERRED EMBODIMENTS

Figure 1:
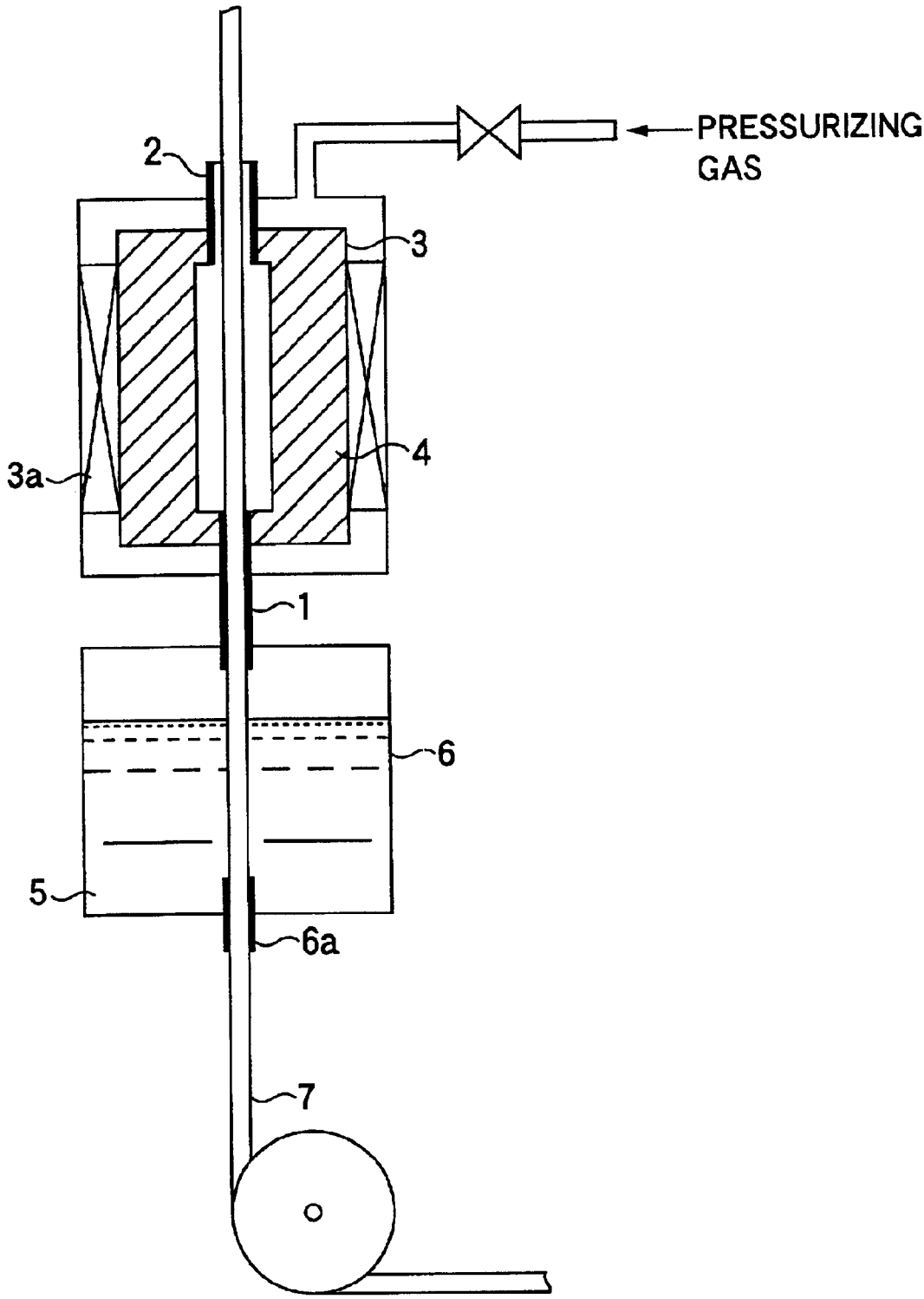
FIG. 1 is a model view showing a molten metal infiltrating apparatus according to the invention.

In a molten metal infiltrating method according to the invention, it is necessary to use a linear material previously coated with a flux. By using such a linear material coated with the flux, the wettability of the surface of the linear material to a molten metal can be improved or the surface tension of a matrix metal can be reduced so that the inside of a linear material bundle can be infiltrated with the molten metal to be a matrix. As a result, it is possible to stably produce an ideal linear composite material having no infiltration defect portion.

In the invention, the flux implies the improvement of the wettability of the surface of the linear material to the molten metal. However, it is necessary to select a flux which does not corrode or degrade a metal to be a linear material or a matrix material, and an inorganic flux or an organic flux which is well known is appropriately selected depending on the type of the metal for a matrix.

For the flux, it is preferable that lithium chloride or sodium chloride should be used for a carbon fiber to be the linear material because the effect of improving the wettability is enhanced.

It is desirable that the flux for coating should be liquefied. Therefore, a flux to be a solid at an ordinary temperature is liquefied by dissolution (or dispersion) through heating or with a proper solvent.

It is necessary to use a linear material to be a reinforcing material which does not cause a change such as decomposition, melting or deterioration at the melting temperature of the matrix, and an inorganic fiber (ceramic fiber) such as a graphite fiber, a carbon fiber, a silicon carbide fiber, a silica fiber or a boron fiber which has poor wettability to the matrix and a metal fiber or a metal wire such as stainless, copper or steel are taken as an example. In the case in which the melting point of a metal for a matrix to be used is low, it is also possible to use an organic fiber such as polyimide and an organic material.

In some cases, a fiber of the linear material has a size agent (sizing agent) sticking onto a surface. In the case in which the effects of the flux are obstructed, therefore, the size agent is removed by using a solvent or through heat cleaning.

A metal such as copper, aluminum, iron, silver, lead, tin or magnesium or their various alloys can be used for the metal to be the material for a matrix. In particular, it is necessary to select a matrix which does not deteriorate the performance of the linear material during the formation of a composite material.

The linear material may be used for the invention in a batch, for example, it may be coated with a flux and once wound upon a bobbin. By introducing the linear material in a molten metal infiltrating apparatus immediately after the coating, productivity can be enhanced remarkably.

In order to apply the flux, a flux coating reservoir may be provided as flux coating means to immerse a linear material in a liquefied flux. Alternatively, means such as spraying, dropping or coating through a roller may be applied as the flux coating means. It is desirable that the whole surface of the linear material should be coated with the flux, and a method of immersing a liquefied flux in a chamber is carried out easily and reliably.

The invention will be specifically described with reference to a model view.

FIG. 1 shows a melting and infiltrating apparatus comprising a bath container 3 having an inlet seal portion 1 in a bottom part and an outlet seal portion 2 in a top part, flux coating means for coating, with a flux, a linear material to be continuously introduced into the bath container through the inlet seal portion in the vicinity of the inlet seal portion, and pressurizing means for maintaining the inside of the bath container in a pressurization state.

A metal ingot 4 to be a material for a matrix is put in the bath container. The metal ingot is hollow and has communicating holes provided in the vicinity of the inlet seal portion and the outlet seal portion of the bath container, and a flux coating reservoir 6 for containing a liquefied flux 5 is provided as flux coating means in the inlet seal portion and a flux coating reservoir lower seal portion 6*a* is provided in the lower part of the flux coating reservoir. A fiber bundle 7 to be a linear material is inserted through the flux coating reservoir lower seal portion 6*a*, the flux coating reservoir 6, the inlet seal portion 1, the bath container 3 and the outlet seal portion 2. The flux coating reservoir 6*a* is flux coating means for coating, with a flux, a linear material to be continuously introduced into the bath container through the inlet seal portion of the bath container.

The inside of the bath container is pressurizing means for maintaining the inside of the bath container in a pressurization state, and is pressurized by a gas bomb for an inert gas (in this example, argon) to the material for a matrix. The outlet seal portion 2 of the bath container 3 acts as an orifice seal. The gas in the bath container leaks in a small amount. Therefore, the inert gas is continuously supplied into the bath container and an internal pressure is maintained to be constant. The inside of the bath container 3 can be heated by a heater 3*a*.

The fiber bundle 7 to be a linear material is continuously supplied from the lower part of the apparatus and is consecutively taken out of the outlet seal portion 2. The flux coating reservoir lower seal portion 6*a* has a small inside diameter and has an orifice seal structure. Therefore, a liquefied flux 5 in the flux coating reservoir 6 can be prevented from leaking. In the flux coating reservoir 6, the surface of each fiber of the fiber bundle 7 is continuously coated with the liquefied flux 5.

Figure 2:
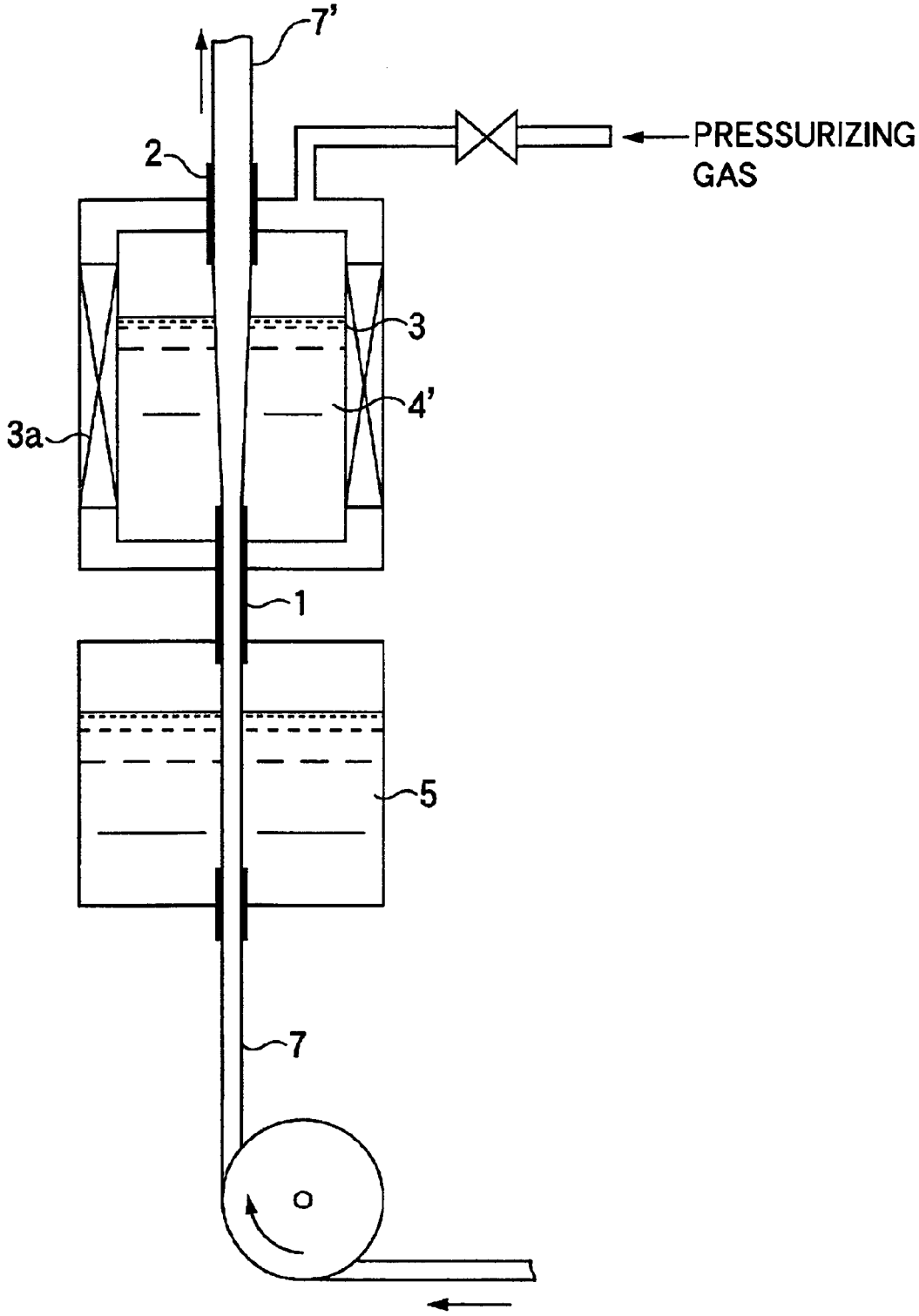
FIG. 2 is a model view showing the operation state of the apparatus in FIG. 1.

When the inside of the bath container 3 is heated by the heater 3*a* in this state, the metal ingot 4 is molten in a portion provided in contact with the internal wall of the bath container 3 and a model state is shown in FIG. 2.

More specifically, the metal ingot 4 in the bath container 3 is molten to be a molten metal 4', and furthermore, the inside of the bath container 3 is pressurized by the gas. Consequently, the molten metal 4' can reach the surface of each fiber of the fiber bundle having the surface coated with the liquefied flux in the flux coating reservoir 6.

Thus, the fiber bundle infiltrated with the molten metal 4' is continuously taken out of the bath container through the outlet seal portion. At this time, the molten metal 4' with which the fiber bundle is infiltrated is solidified so that a linear composite material 7' is formed.

In a molten metal infiltrating method for a linear material in which the linear material to be a core is continuously introduced through the inlet seal portion provided in the bottom part of the bath container having a molten metal on the pressurized inside and is consecutively taken out of the outlet seal portion provided in the top part of the infiltrating reservoir by using the apparatus, it is possible to continuously coat, with a flux, the linear material introduced into the bath container through the inlet seal portion.

As a result, a linear composite material to be manufactured does not have a defect portion such as a void but is excellent in sealing properties of the matrix and the linear material, and original performance such as a mechanical characteristic can be displayed sufficiently.

Figure 3:
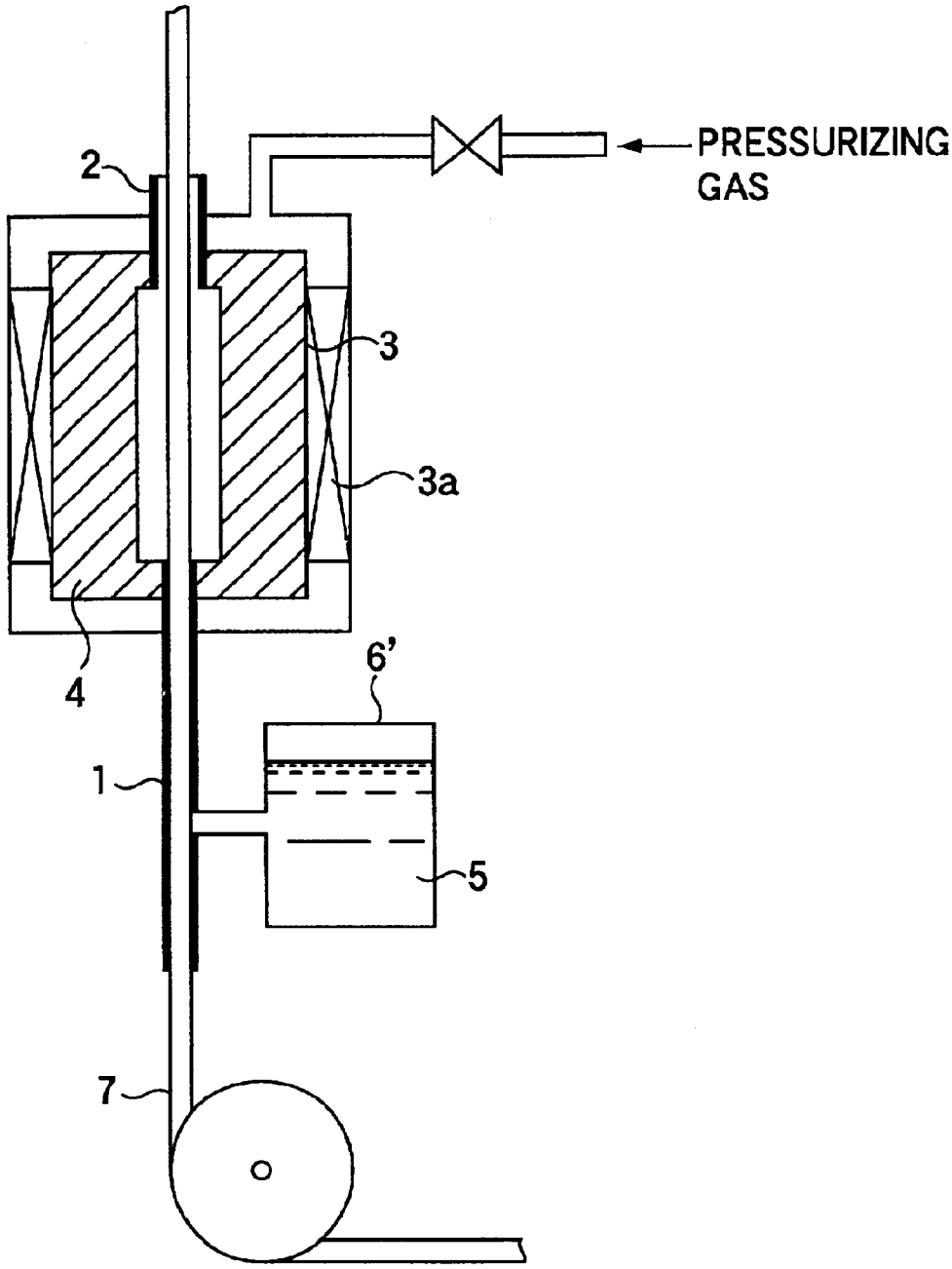
FIG. 3 is a model view showing another molten metal infiltrating apparatus according to the invention.
Figure 4:
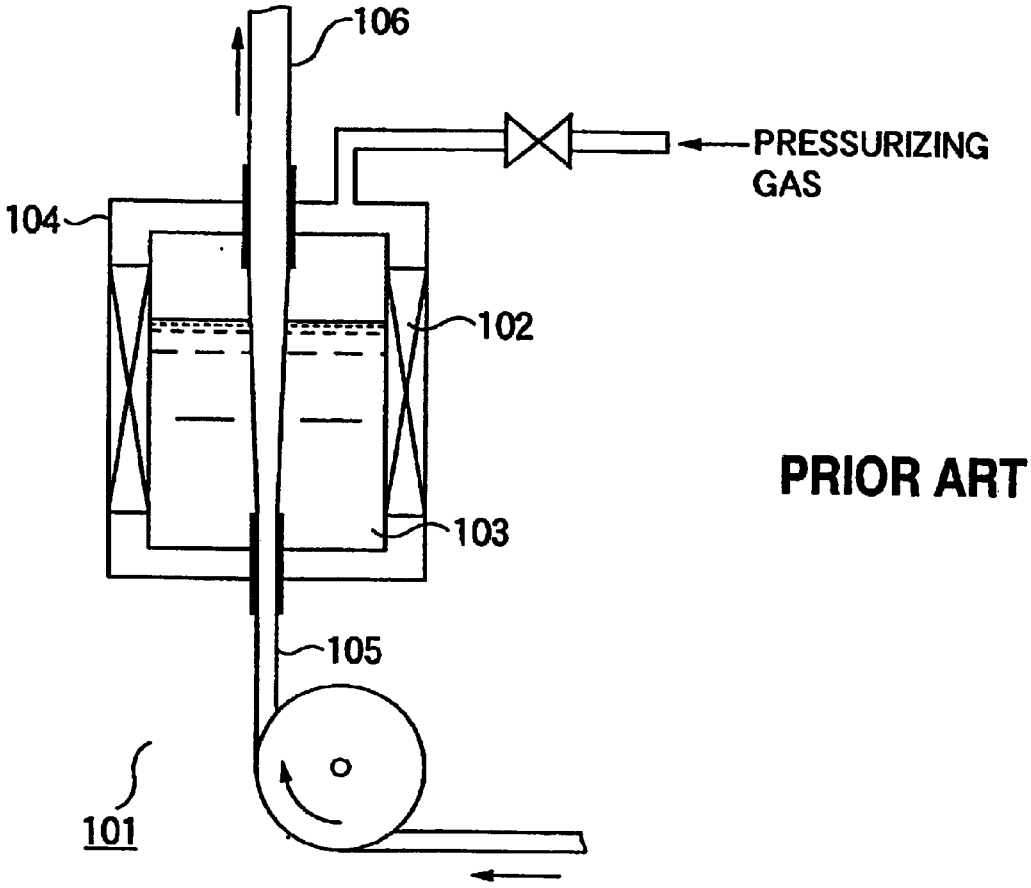
FIG. 4 is a model view showing a conventional molten metal infiltrating apparatus.
Figure 5:
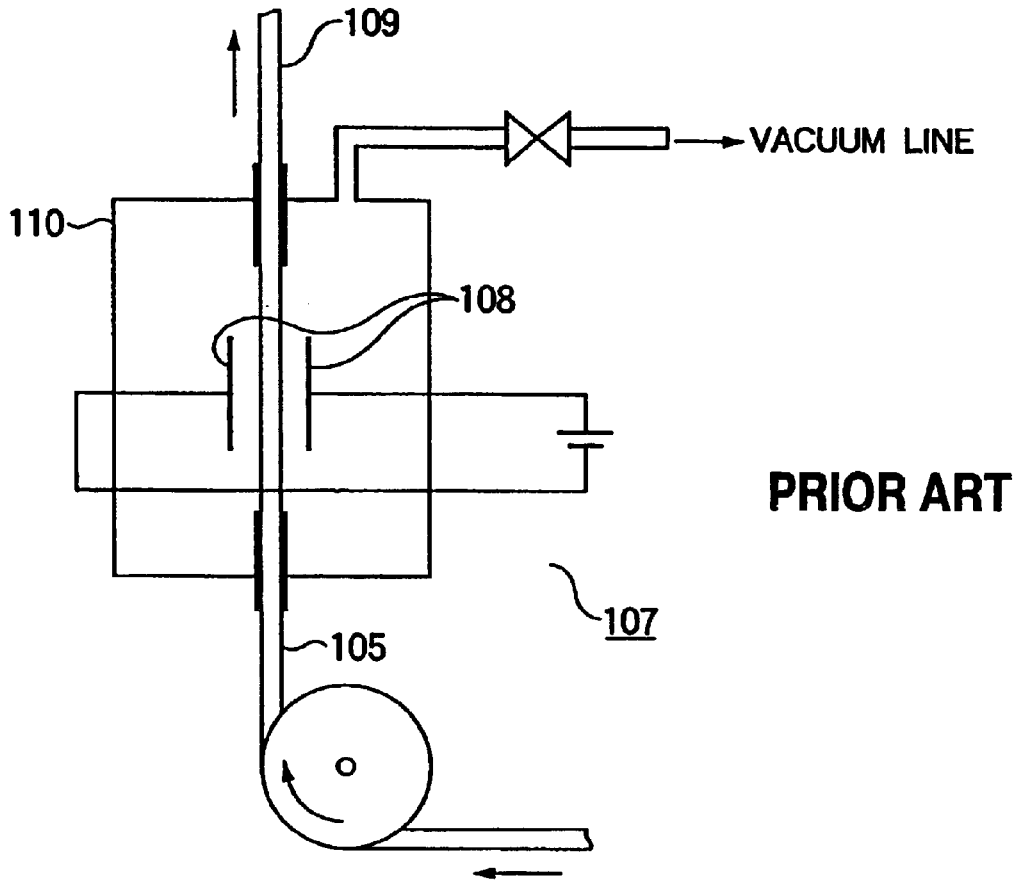
FIG. 5 is a model view showing a metal spraying and vacuum depositing apparatus to be used together in the conventional molten metal infiltrating apparatus.

FIG. 3 is a model view showing another example of the molten metal infiltrating apparatus according to the invention.

While a bath container 3 portion of the apparatus has the same structure as that in the molten metal infiltrating apparatus shown in FIGS. 1 and 2, an inlet seal portion 1 provided in the bottom part of the bath container 3 has a flux supply reservoir 6' as flux coating means for coating, with a flux, a linear material (fiber bundle) 7 continuously introduced into the bath container 3 through the inlet seal portion 1. A small hole (not shown) is provided in the upper part of the flux supply reservoir 6' and a liquefied flux in the supply reservoir 6' is supplied in a small amount to the inlet seal portion 1 of the bath container 3.

The fiber bundle 7 to be a linear material which reaches the inlet seal portion 1 of the bath container 3 comes in contact with a liquefied flux 5 supplied in a small amount from the inside of the flux supply reservoir 6' so that the surface of each fiber of the fiber bundle 7 is coated with the flux 5. Thus, an excellent linear composite material can be formed by the fiber coated with the flux and the molten metal in the bath container (while the drawing shows an ingot which has not been molten, a molten metal is obtained by the heating of a heater 3*a*).

The invention provides an excellent molten metal infiltrating method which has high productivity and can obtain a linear composite material having ideal performance at a low cost.

The invention provides an excellent molten metal infiltrating apparatus capable of obtaining a linear composite material having ideal performance at a low cost.

What is claimed is:

1. A molten metal infiltrating method for infiltrating a linear material with a molten metal, wherein the linear material previously is coated with a flux immediately before the material is infiltrated with the molten metal, wherein the linear material is a carbon fiber and the flux is lithium chloride or sodium chloride.

2. A molten metal infiltrating method comprising the steps of:

continuously introducing a linear material, to be a core, into a bath container through an inlet seal portion provided in a bottom part of the bath container, having a molten metal in a pressurized inside;

consecutively drawing the linear material out of an outlet seal portion provided in a top part of the bath container, and continuously coating the linear material, introduced into the bath container through the inlet seal portion, with a flux by a flux coating reservoir directly attached to one end of the inlet seal portion, such that the linear material is introduced into the bath container immediately after coating with the flux, wherein the linear material is a carbon fiber and the flux is lithium chloride or sodium chloride.

3. A molten metal infiltrating apparatus comprising:

a bath container having an inlet seal portion in a bottom part; and flux coating means for coating, with a flux, a linear material continuously introduced into the bath container through the inlet seal portion, the flux coating means provided immediately prior to the inlet seal portion, wherein the flux coating means is directly attached to one end of the inlet seal portion.

4. The molten metal infiltration apparatus of claim 3, further comprising a source for a carbon fiber to be used as the linear material and a source for lithium chloride or sodium chloride to be used as the flux.

5. A molten metal infiltration apparatus comprising:

a gas-pressurized bath container having an inlet seal portion in a bottom part capable of continuously receiving a linear material; and a flux coating reservoir for coating the linear material with a flux, wherein a top portion of the flux coating reservoir is directly connected to the inlet seal portion of the bath container.

6. A molten metal infiltration apparatus comprising:

a gas-pressurized bath container having an inlet seal portion in a bottom part capable of continuously receiving a linear material; and a flux coating reservoir for coating the linear material with a flux, wherein a side portion of the flux coating reservoir is directly connected to the inlet seal portion of the bath container.

* * * * *